US007828704B1

(12) United States Patent
Hsieh et al.

(10) Patent No.: US 7,828,704 B1
(45) Date of Patent: Nov. 9, 2010

(54) COMBINATION LIMB AND ABDOMINAL EXERCISER

(76) Inventors: Jung-Pao Hsieh, No. 64, Lane 289, Ceen Yuan Rd., Chung-Li City, Taoyuan Hsien (TW); Ming-Cheng Chiang, No. 16, Aly. 10, Ln. 588, Sec. 4, Zhongzheng Rd., Zhongli City, Taoyuan County (TW)

( * ) Notice: Subject to any disclaimer, the term of this patent is extended or adjusted under 35 U.S.C. 154(b) by 0 days.

(21) Appl. No.: 12/536,867

(22) Filed: Aug. 6, 2009

(51) Int. Cl.
*A63B 21/00* (2006.01)

(52) U.S. Cl. ..... 482/126; 482/127; 482/121

(58) Field of Classification Search ..... 482/127, 482/126, 121, 138, 139
See application file for complete search history.

(56) References Cited

U.S. PATENT DOCUMENTS 4,861,022 A * 8/1989 Boatcallie ..... 482/126
5,507,712 A * 4/1996 Chang ..... 482/126
5,743,830 A * 4/1998 Ho ..... 482/44

* cited by examiner

*Primary Examiner*—Jerome Donnelly
(74) *Attorney, Agent, or Firm*—Jackson IPG PLLC; Demian K. Jackson

(57) ABSTRACT

The combination limb and abdominal exerciser of the present invention has a first torsional spring coupled between two rods of a set of pivotally connected rod members, such that the expansion or compression of the first torsional spring provides an exercise resistance when the two rods are moved outward away from or moved inward closer to each other by an external force, and the two rods return by the resilience of the first torsional spring when the external force is released, so as to help a user to exercise the upper limbs or exercise the lower limbs. Furthermore, a handle can be axially disposed at the end of each of the two rods, and a second torsional spring is disposed between each handle and the corresponding rod. The user can hold the handles and make the rods to rotate with respect to each other for wrist exercise.

6 Claims, 9 Drawing Sheets

COMBINATION LIMB AND ABDOMINAL EXERCISER

BACKGROUND OF THE INVENTION (a) Field of the Invention

The present invention relates to an exercise device, and more particularly to a combination limb and abdominal exerciser that can help a user to exercise the upper limbs or exercise the lower limbs.

(b) Description of the Prior Art

It is well known that adequate exercise can improve cardiopulmonary function and physical tolerance, promote the health and strength of muscles/bones, maintain basal metabolism, consume calories and fat, as well as decrease the occurrence of diseases and complications. However, a lot of people have no time to exercise outdoors in their bustle lives. They often cannot get outdoor exercise due to tense lives, busy affairs and the weather, etc.

Therefore, numerous exercise devices for indoor use are available on the market in hopes of meeting the need of busy modern people for adequate exercise. Among them, there is no lack of some exercise devices which simulate outdoor exercise modes, such as exercise bicycles, treadmills, and rowing machines. Such devices that can simulate outdoor exercise modes are not only large in volume, but also relatively expensive. Moreover, most of them only have a single exercise mode or function.

Additionally, there are a lot of exercise devices specially adapted for training specific parts of a human body available on the market, such as dumbbells, grip exercise devices, grip exercise bars and the like. Likewise, such devices specially adapted for training specific parts of a human body only have a single exercise mode or function. This results in markedly insufficient practicality and may further cause the operator to lose his or her interest in exercise gradually.

SUMMARY OF THE INVENTION

In view of the above-mentioned circumstances, a primary object of the present invention is to provide a combination limb and abdominal exerciser that can help a user to exercise the upper limbs or exercise the lower limbs.

To achieve the foregoing object, the combination limb and abdominal exerciser of the present invention has a set of pivotally connected rod members having two rods which can be moved outward away from or moved inward closer to each other, and a first torsional spring disposed between the two rods so as to normally maintain a fixed included angle between the two rods. Besides, the expansion or compression of the first torsional spring provides an exercise resistance when the two rods are moved outward away from or moved inward closer to each other by an external force.

The entire combination limb and abdominal exerciser can allow a user to hold the rods with hands and the two rods can be moved outward away from or moved inward closer to each other to a certain extent by the force of the hands so as to achieve the goal of exercising upper limbs; moreover, it can allow a user to prop the rods with legs and the two rods can be moved outward away from or moved inward closer to each other to a certain extent by the force of the legs so as to achieve the goal of exercising lower limbs.

Another object of the present invention is to provide a combination limb and abdominal exerciser. When an upper limb exercise is performed, the pivotally connected ends of the two rods can be simultaneously propped against the abdomen and the combination limb and abdominal exerciser is supported by the force of the abdomen to achieve the goal of exercising abdominal muscles.

A further object of the present invention is to provide a combination limb and abdominal exerciser in which a handle is axially disposed at the end of each of the two rods, and a second torsional spring is disposed between each handle and the corresponding rod such that a user can hold the handles with hands and the handles are swung by the force of the wrists to achieve the goal of exercising wrists.

DETAILED DESCRIPTION OF THE PREFERRED EMBODIMENTS

Figure 1:
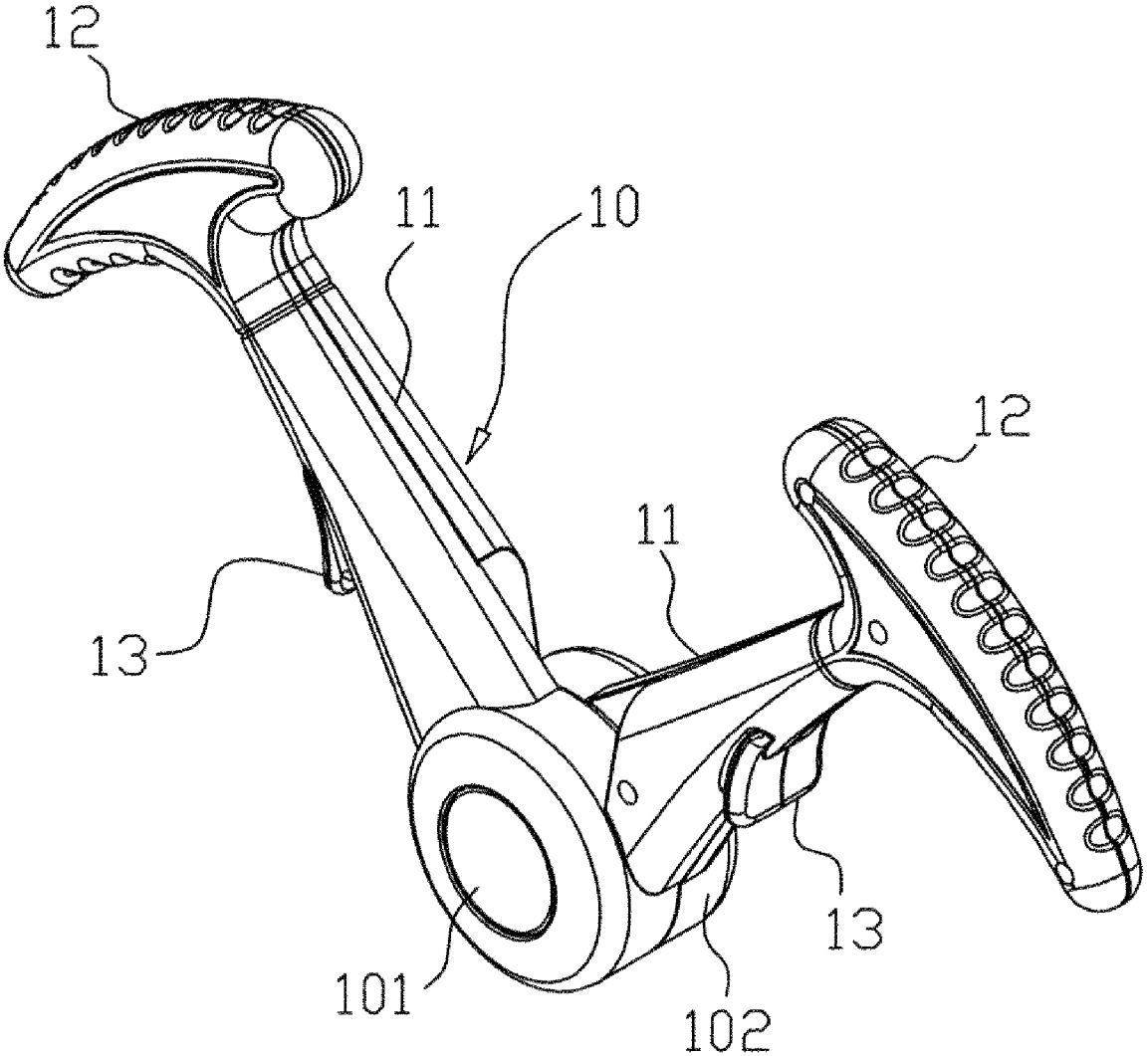
FIG. 1 is a three-dimensional view showing the appearance of a combination limb and abdominal exerciser according to the present invention.
Figure 2:
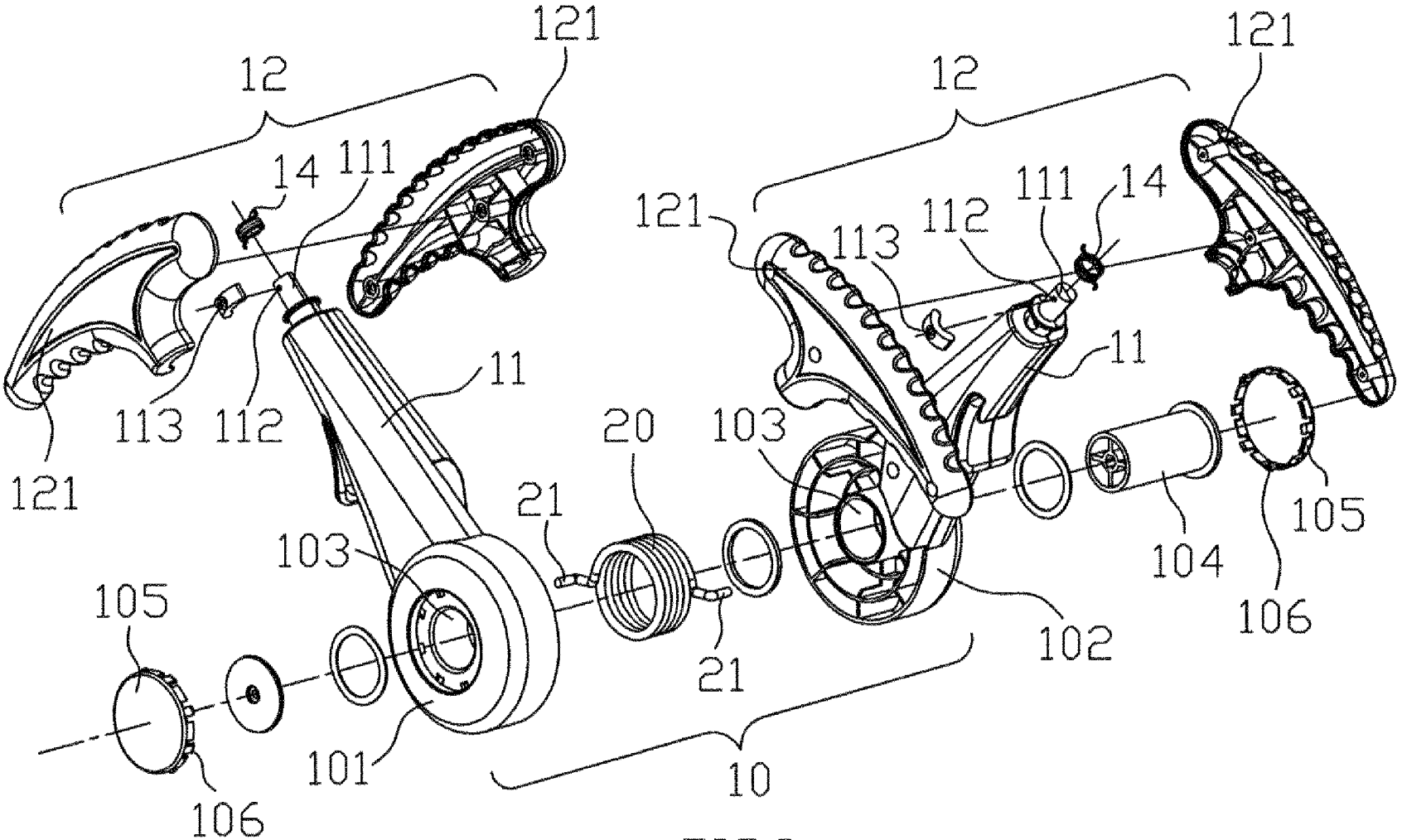
FIG. 2 is an exploded view showing a structure of a combination limb and abdominal exerciser according to the present invention.
Figure 3:
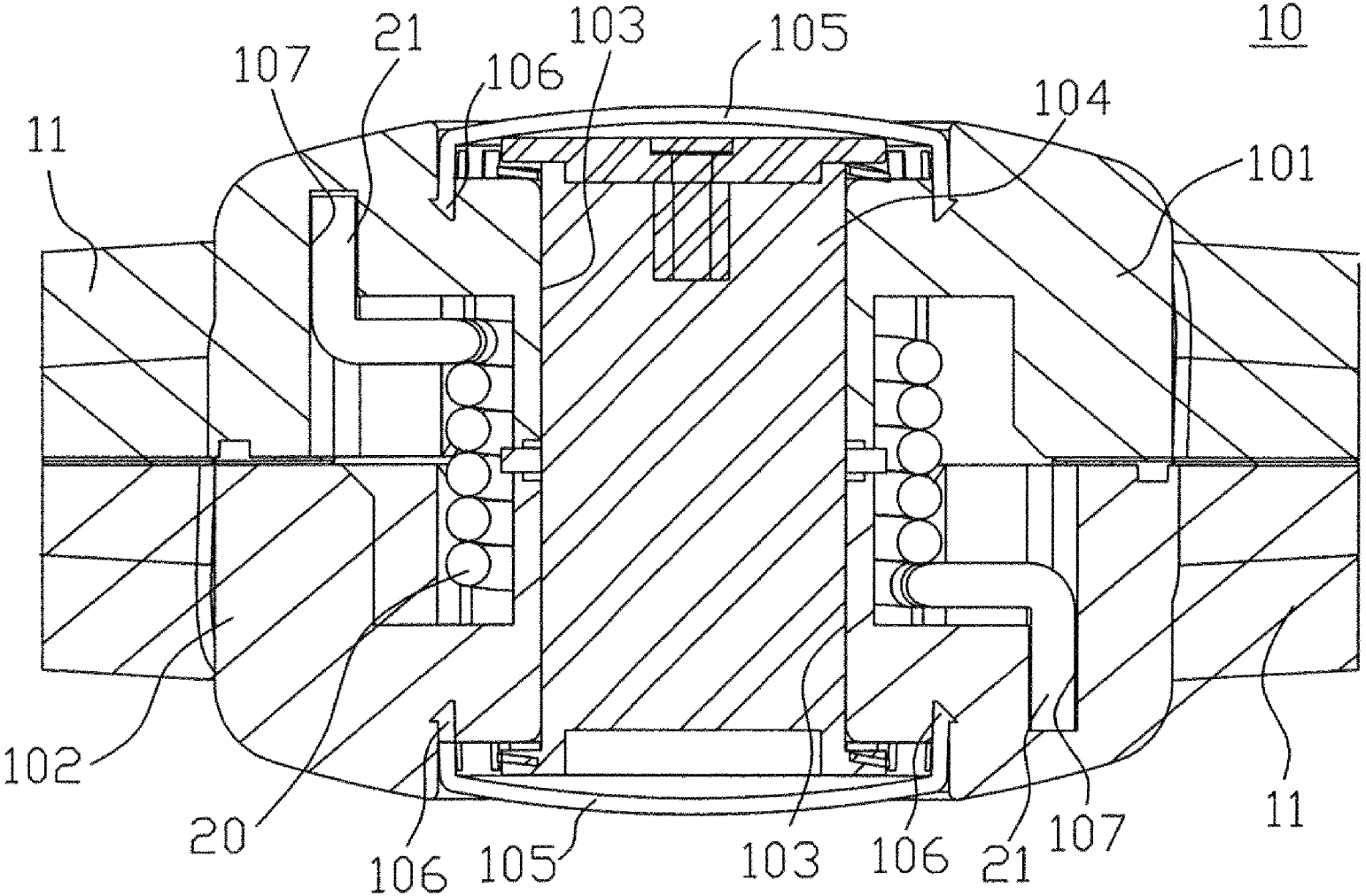
FIG. 3 is a cross-sectional view showing a structure of the pivotally connected ends of the two rods according to the present invention.
Figure 4:
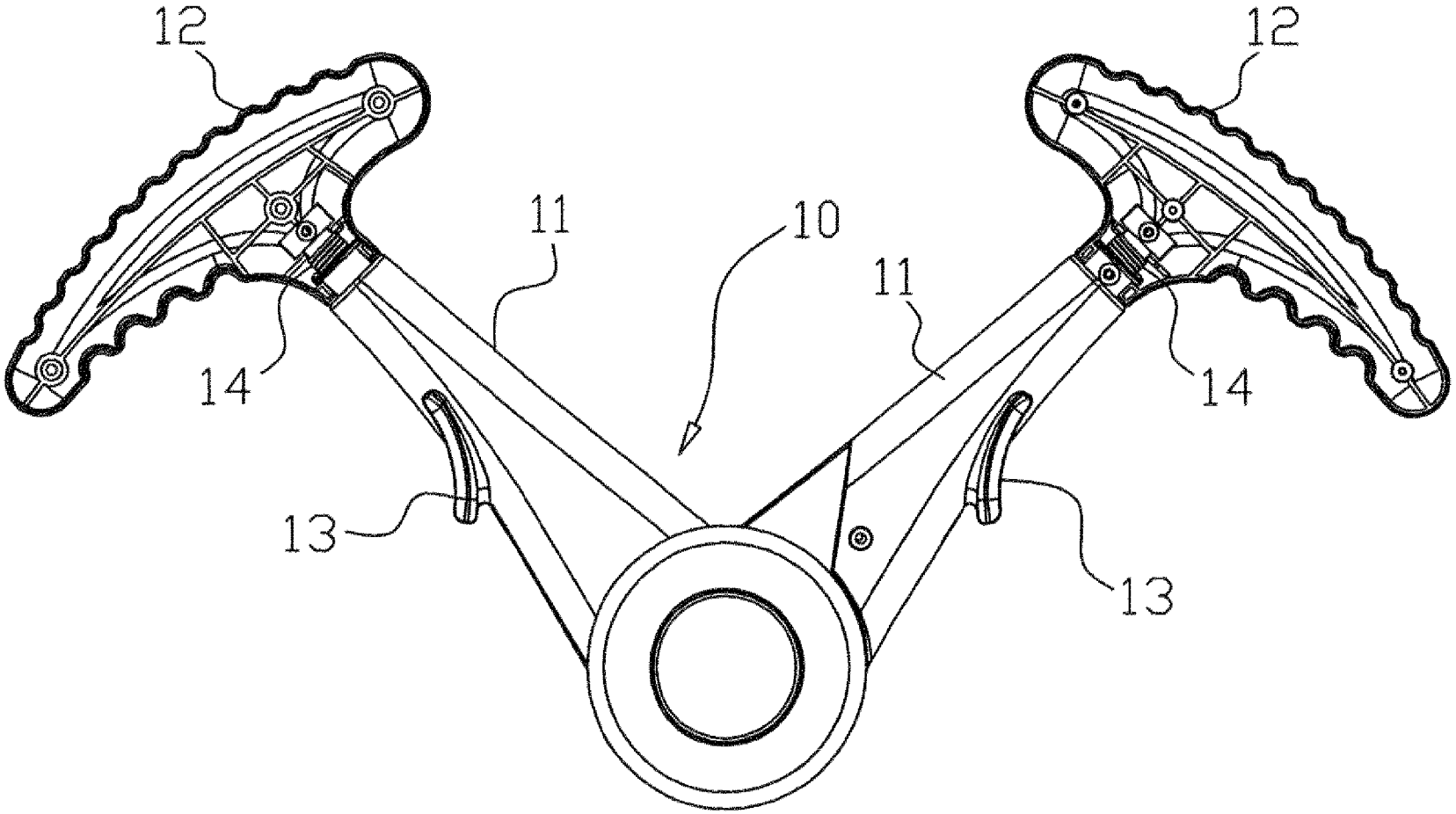
FIG. 4 is a cross-sectional view showing a structure of a combination limb and abdominal exerciser according to the present invention.

As illustrated in FIGS. 1 to 3, the combination limb and abdominal exerciser of the present invention comprises: a set of pivotally connected rod members 10 and a first torsional spring 20.

The set of pivotally connected rod members 10 includes first and second main bodies 101, 102 which can be assembled and fixed to each other. Each of the first and second main bodies 101, 102 has an extending rod 11. The two rods 11 can be moved outward away from or moved inward closer to each other. The first torsional spring 20 is disposed between the first and second main bodies 101, 102 of the set of pivotally connected rod members 10 so as to normally maintain a fixed included angle between the two rods 11. The expansion or compression of the first torsional spring 20 provides an exercise resistance when the two rods 11 are moved outward away from or moved inward closer to each other by an external force, and the two rods 11 return by the resilience of the first torsional spring 20 when the external force is released. Each of the first and second main bodies 101, 102 has a through hole 103 and a groove 107 disposed on the periphery of the through hole. A post 104 passes through the two through holes 103. The post 104 is mounted around by the first torsional spring 20. The two ends of the first torsional spring 20 are provided with root portions 21. The inclined angle between the two root portions 21 can be 90 to 180 degrees (preferably 108 degrees). The root portions 21 extend from the first torsional spring 20 respectively to the first and second main bodies 101, 102, and further extend into and engage the groove 107. The through holes 103 are respectively covered by covers 105 which are respectively fixed to the first and second main bodies 101, 102 by means of locking portions 106. Thus, the assembly of the entire combination limb and abdominal exerciser is completed.

Furthermore, handles 12 are disposed at the ends of the two rods 11 of the set of pivotally connected rod members 10 to be held by a user. Two halves 121 are mutually assembled to form each of the handles 12. Soft plastic pieces 13 are provided on the sides of the two rods 11 corresponding to the handles 12. The soft plastic pieces 13 serve as structures to be propped against by a user's legs.

Figure 8:
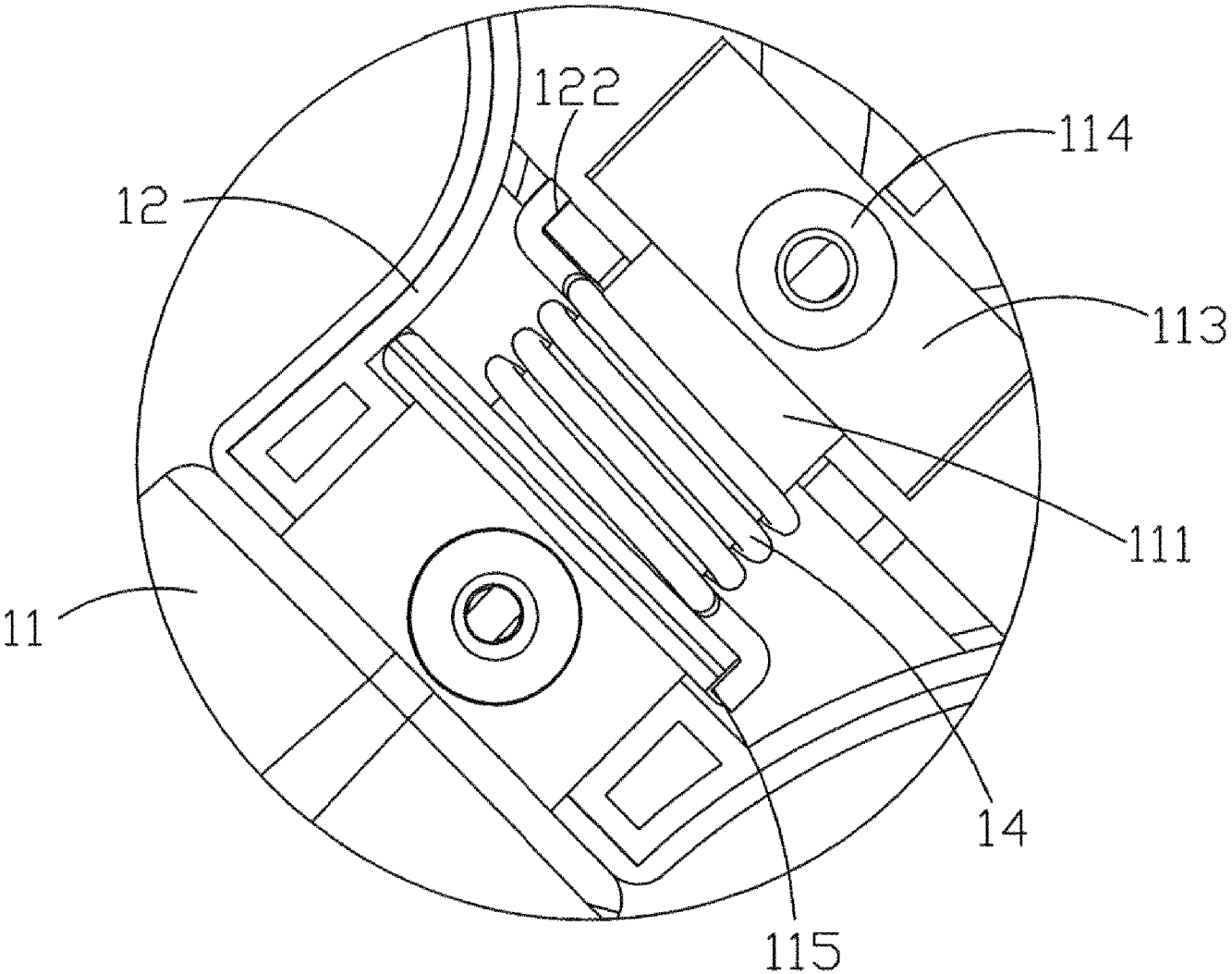
FIG. 8 is a cross-sectional view showing a structure of the axially connected position of the handle and the rod according to the present invention.
Figure 9:
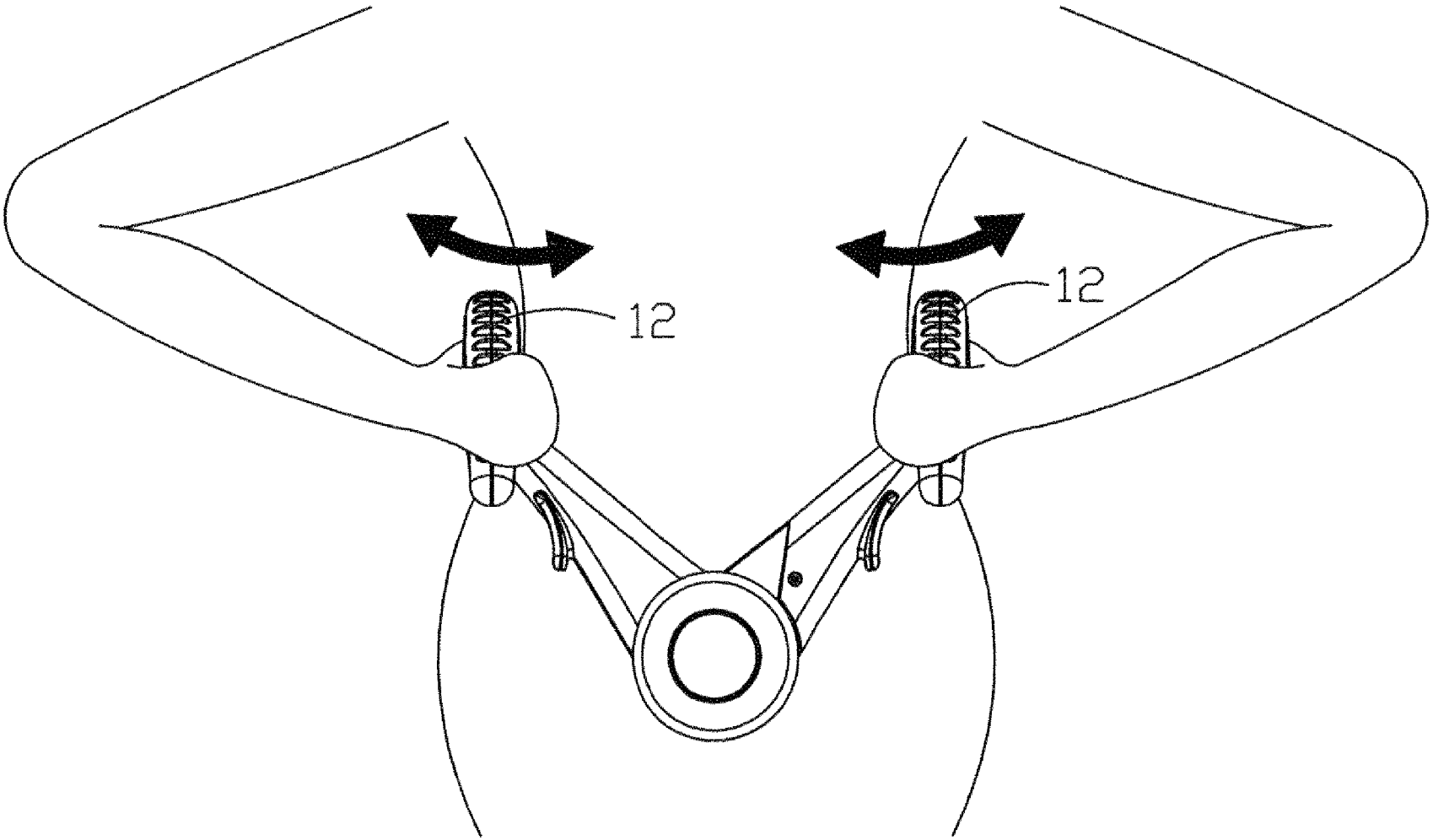
FIG. 9 is a reference view showing the use of the combination limb and abdominal exerciser according to the present invention for exercising wrist muscles.

In the implementation, the two handles 12 are respectively axially disposed at the ends of the two rods 11. A second torsional spring 14 is disposed between each handle 12 and the corresponding rod 11, as illustrated in FIGS. 2 and 8. The end of each of the two rods 11 is formed with a sub-rod 111 which has a locking hole 112 thereon so that the second torsional spring 14 can be mounted around the sub-rod 111 and then a locking cap 113 is covered on the locking hole 112 and locked by a screw so as to fix the second torsional spring 14 to the rod 11. One end of the second torsional spring 14 enters a first through hole 115 preset on the rod 11, and the other end of the second torsional spring 14 enters a second through hole 122 preset on the handle 12 such that the second torsional spring 14 can be coupled between the rod 11 and the handle 12. The user can hold the handles 12 and make the rods 11 to rotate with respect to each other. Also referring to FIG. 9, the second torsional spring 14 can provide a rotation resistance to achieve the goal of exercising wrists. When the user releases the handles 12, the second torsional spring 14 returns by the resilience thereof.

Figure 5:
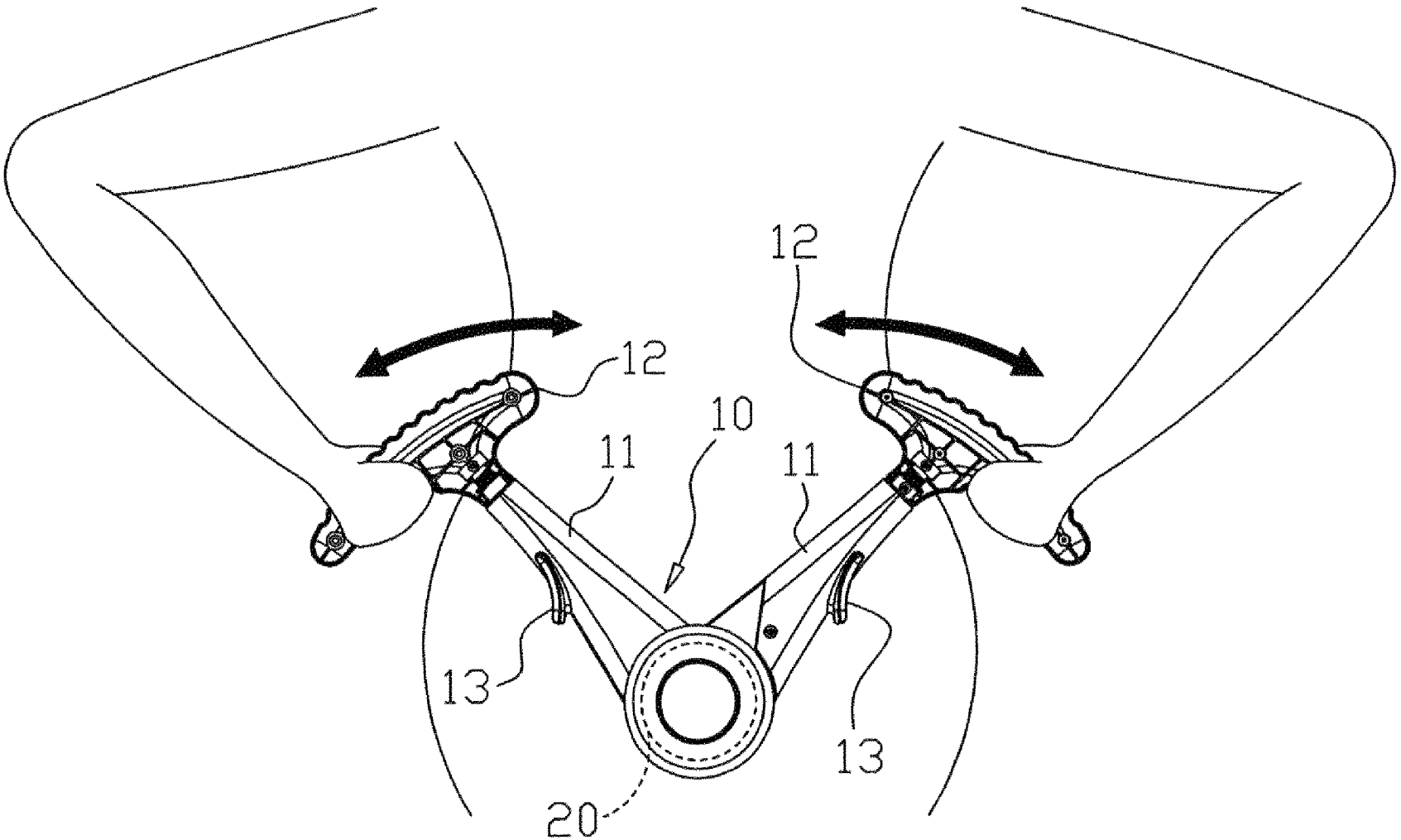
FIG. 5 is a reference view showing the use of the combination limb and abdominal exerciser according to the present invention for exercising upper limbs.
Figure 6:
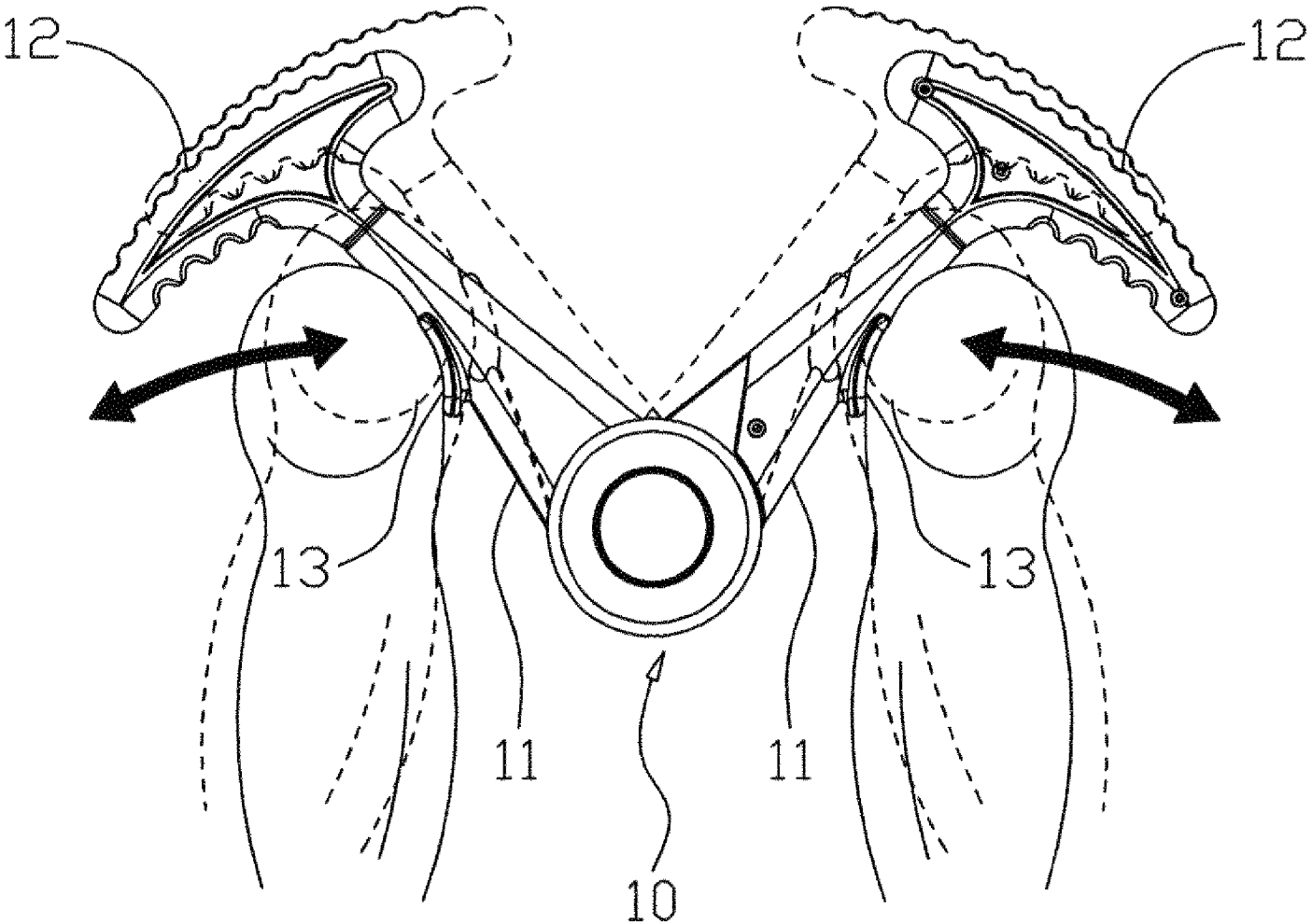
FIG. 6 is a reference view showing the use of the combination limb and abdominal exerciser according to the present invention for exercising lower limbs.

As illustrated in FIG. 5, in use of the combination limb and abdominal exerciser of the present invention, it can allow a user to hold the rods 11 with hands and the two rods 11 can be moved outward away from or moved inward closer to each other to a certain extent by the force of the hands so as to achieve the goal of exercising upper limbs; moreover, as illustrated in FIG. 6, it can allow a user to prop the rods 11 with legs and the two rods 11 can be moved outward away from or moved inward closer to each other to a certain extent by the force of the legs so as to achieve the goal of exercising lower limbs.

Figure 7:
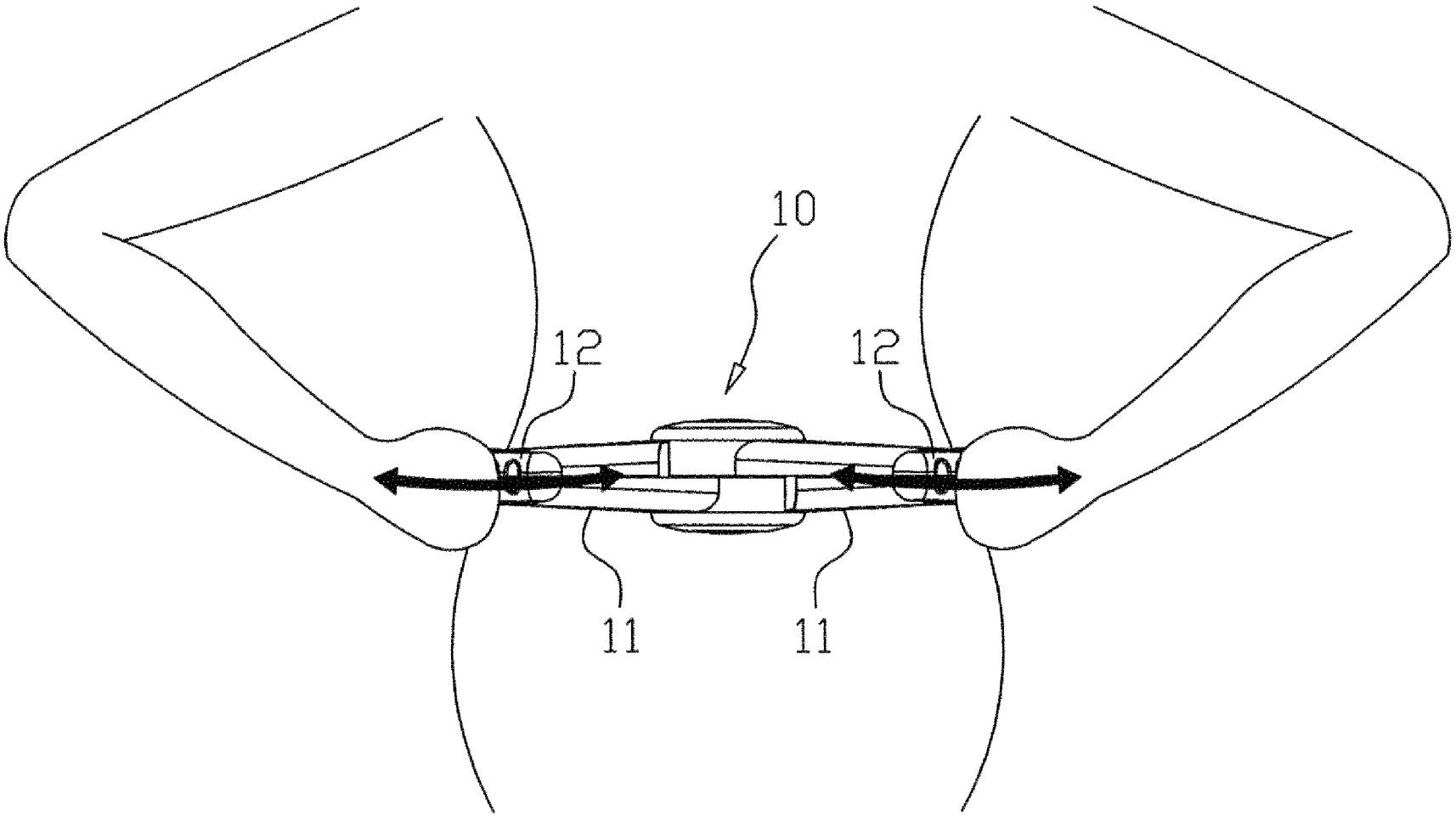
FIG. 7 is a reference view showing the use of the combination limb and abdominal exerciser according to the present invention for exercising abdominal muscles.

Furthermore, as illustrated in FIG. 7, when an upper limb exercise is performed, the pivotally connected ends of the two rods 11 can be simultaneously propped against the abdomen and the combination limb and abdominal exerciser is supported by the force of the abdomen to achieve the goal of exercising abdominal muscles.

As concluded from the above-mentioned, the prevent invention provides an improved structure of a combination limb and abdominal exerciser, and the application for a utility model patent is duly filed accordingly. The technical contents and features of the present invention are disclosed above. However, anyone familiar with the technique could possibly make modify or change the details in accordance with the present invention without departing from the spirit of the invention. The protection scope of the present invention shall not be limited to what embodiment discloses, and should include various modification and changes that are made without departing from the spirit of the present invention, and should be covered by the claims mentioned below.

What is claimed is:

1. A combination limb and abdominal exerciser, comprising: a set of pivotally connected rod members including first and second main bodies which can be assembled and fixed to each other, each of said first and second main bodies having an extending rod, the two rods being able to be moved outward away from or moved inward closer to each other, and a handle being disposed at the end of each of the rods, wherein each of said first and second main bodies has a through hole and a groove disposed on the periphery of the through hole, and a post passes through the two through holes which are respectively covered by covers which are respectively fixed to the first and second main bodies by means of locking portions;

two handles, each of which is pivotally disposed at an end thereof to the end of each of said two rods, so that the handles, when subjected to an external force, rotate at an angle about a longitudinal axis of the extending rod, and a second torsional spring is disposed between each handle and the corresponding rod to bias against the rotation of said handles; and a first torsional spring, which is mounted around said post and disposed between the two rods of said set of pivotally connected rod members so as to normally maintain a fixed included angle between the two rods and provide an exercise resistance when the two rods are moved outward away from or moved inward closer to each other by an external force, wherein the end of each of the two rods is formed with a sub-rod, and the second torsional spring is mounted around said sub-rod on which a locking cap is securely mounted above the second torsional spring, wherein a locking hole is disposed on said sub-rod for the fixation of said locking cap, and wherein one end of said second torsional spring enters a first through hole preset on the rod, and the other end of said second torsional spring enters a second through hole preset on the handle.

2. The combination limb and abdominal exerciser as set forth in claim 1, wherein soft plastic pieces are provided on the sides of said two rods to be leaned against by a user's legs.

3. The combination limb and abdominal exerciser as set forth in claim 1, wherein two halves are mutually assembled to form each of said handles.

4. The combination limb and abdominal exerciser as set forth in claim 1, wherein the two ends of said first torsional spring are provided with root portions which extend from the first torsional spring respectively to the first and second main bodies and further extend into and engage the groove.

5. The combination limb and abdominal exerciser as set forth in claim 4, wherein the inclined angle between the two root portions is 90 to 180 degrees.

6. The combination limb and abdominal exerciser as set forth in claim 5, wherein the inclined angle between the two root portions is 108 degrees.

* * * * *